US006510633B1

(12) United States Patent
Bledsoe

(10) Patent No.: US 6,510,633 B1
(45) Date of Patent: Jan. 28, 2003

(54) PANEL ILLUSTRATION APPARATUS

(76) Inventor: William C. Bledsoe, 2817 W. Fountain Blvd., Tampa, FL (US) 33609

( * ) Notice: Subject to any disclaimer, the term of this patent is extended or adjusted under 35 U.S.C. 154(b) by 0 days.

(21) Appl. No.: 09/602,026

(22) Filed: Jun. 23, 2000

(51) Int. Cl.[7] ..... G09F 13/02
(52) U.S. Cl. ..... 40/559; 362/220; 362/427
(58) Field of Search ..... 362/220, 224, 362/427; 40/559, 714, 715

(56) References Cited

U.S. PATENT DOCUMENTS

| | | | | |
|---|---|---|---|---|
| 2,551,622 A | | 5/1951 | Mohr | |
| 2,634,530 A | | 4/1953 | Herschede et al. | |
| 3,742,203 A | * | 6/1973 | Noe | 40/559 |
| 4,118,766 A | * | 10/1978 | Kredo | 362/427 |
| 4,204,274 A | * | 5/1980 | Luderitz | 362/220 |
| 4,996,632 A | | 2/1991 | Aikens | |
| 5,219,217 A | | 6/1993 | Aikens | |
| 5,371,656 A | | 12/1994 | Iorfida | |

* cited by examiner

*Primary Examiner*—Cassandra Davis
(74) *Attorney, Agent, or Firm*—Howison, Thoma & Arnott, L.L.P.

(57) ABSTRACT

An apparatus for illuminating a display panel is disclosed comprising an elongated housing for an illuminating assembly having a generally U-shaped cross-section, an open side and a light reflecting interior surface disposed around and forward of the perimeter of the display panel such that the open side of the housing substantially faces the front display surface of the display panel; a light source within the housing wherein light is radiated through the open side of the housing toward the front display surface of the display panel; and a frame attached to the perimeter of the display panel for supporting the housing in a pivotable relationship with the frame. The housing may be pivoted away from the front display surface of the display panel. In one aspect of the present disclosure, the elongated housing is configured in a plurality of elongated segments disposed in end-to-end relationship around the perimeter of the display panel. In another aspect, various control means are provided for controlling the light from the light source.

39 Claims, 5 Drawing Sheets

PANEL ILLUSTRATION APPARATUS

TECHNICAL FIELD OF THE INVENTION

The present disclosure is directed to a panel illumination apparatus and, more particularly, apparatus for illuminating a display panel such as a sign or billboard, that provides illumination of both the surface and the border of the display panel and provides improved service access.

BACKGROUND OF THE INVENTION

Various methods and devices have been employed to provide and enhance the illumination of a display panel such as a sign or a billboard. Some examples of the prior art, such as U.S. Pat. No. 2,551,622 issued to Mohr, U.S. Pat. No. 2,634,530 issued to Herschede et al. and U.S. Pat. No. 5,371,656 issued to Iorfida provide for illuminating a sign or display panel through its edges utilizing panel construction or light source configurations to achieve the intended purpose. Such approaches have drawbacks in that special construction of the sign or display panel or of the lighting fixture is required which increases cost and reduces adaptability of the lighting devices to a variety of sign sizes and shapes. An elongated light source, as disclosed is U.S. Pat. Nos. 4,996,632 and 5,219,217 issued to Aikens, for providing more even distribution of illumination for signs suffers from a similar drawback of not utilizing standard light source fixtures in a simple configuration that is easy to install and service. What is needed is a lighting system for illuminating a display panel surface or its border that utilizes standard lighting fixtures and control components in a simple configuration that provides for easy service access and ready adaptability to a variety of applications for outdoor or indoor signage and display panels.

SUMMARY OF THE INVENTION

An apparatus for illuminating a display panel is disclosed comprising an elongated housing for an illuminating assembly having a generally U-shaped cross-section, an open side and a light reflecting interior surface disposed around and forward of the perimeter of the display panel such that the open side of the housing substantially faces the front display surface of the display panel; a light source within the housing wherein light is radiated through the open side of the housing toward the front display surface of the display panel; and a frame attached to the perimeter of the display panel for supporting the housing in a pivotable relationship with the frame. The housing may be pivoted away from the front display surface of the display panel. In one aspect of the present disclosure, the elongated housing is configured in a plurality of elongated segments disposed in end-to-end relationship around the perimeter of the display panel for illuminating the surface of the display panel. In another aspect a second plurality of elongated lighting assemblies may be disposed in end-to-end relationship around the perimeter of the display panel to provide an illuminated border of the display panel. In yet another aspect, various control means are provided for controlling the light from the light sources.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
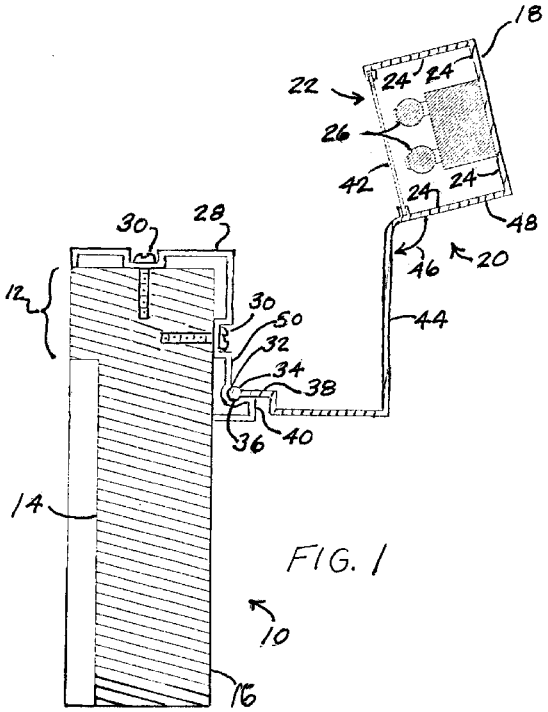
FIG. 1 illustrates a cross-section view of an upper portion of a display panel and an embodiment of the panel illumination apparatus shown in an open (second) position for service.

Referring now to FIG. 1, there is illustrated a cross-section view of an upper portion of a display panel and an embodiment of the panel illumination apparatus according to the present disclosure. The panel illumination apparatus is shown in a second, open position for service, The display panel 10 includes a perimeter or frame portion 12, a front surface 14 and a rear surface 16. The panel illumination apparatus 20 includes an elongated housing 18 that has a generally U-shaped cross-section and an open side 22. The elongated housing 18 also has a light reflecting interior surface 24 and the elongated housing 18 is shown with a first light source 26 mounted within the U-shaped cross-section of the elongated housing 18. Also shown in FIG. 1 is an elongated frame 28 shown secured to the perimeter 12 of the display panel 10 with threaded fasteners 30 passing through the elongated frame 28 into the material of the perimeter 12 of the display panel 10. In the illustrative embodiment shown in FIG. 1, there is shown one example of a hinge means 32 which is formed to be integral with the elongated frame 28 and a rearward extension 44 of the elongated housing 18. A ball 34 portion, formed into a rearward edge 38 of a rearward extension 44 of the elongated housing 18 cooperates with a socket 36 portion of a rearward edge 40 of the elongated frame 28 to form a ball and socket arrangement which provides for securing the elongated housing 18 to the elongated frame 28 in a pivotable relationship between them. The elongated housing 18 has provision for a translucent lens 42 to be placed across the open side 22 of the elongated housing 18. The rearward extension 44 of the elongated housing 18 extends from a rearward side 48 of the elongated housing 18 at an obtuse angle 46 as illustrated in FIG. 1.

Continuing with FIG. 1, in one embodiment the elongated housing 18 including its rearward extension 44 and the elongated frame 28 and its rearward extension 40 may be formed by extrusion of a rigid material such as aluminum or any of several available plastic materials suitable for this particular purpose. Such extrusions, which are characterized by relatively low manufacturing cost as well as high strength and the ability to incorporate integral features such as the ball and socket hinge means 32, enable minimizing the number of parts required to provide the panel illumination apparatus of the present disclosure. In addition to the ball and socket hinge means 32, the threaded fasteners 30, shown inserted through respective channel portions of the elongated frame 28, serve both to secure the elongated frame 28 to the perimeter frame 12 of the display panel 10 and to provide stiffness to the elongated frame 28 enabling it to serve as a suitable support for the illuminating assembly. The threaded fasteners 30 are merely representative of any number of fastening devices which may be used to secure the elongated frame 28 to the display panel 10. The particular choice of fastener will depend on the particular application. Thus, a variety of different fastening devices may be used without departing from the scope of the panel illumination apparatus of the present disclosure.

Figure 2:
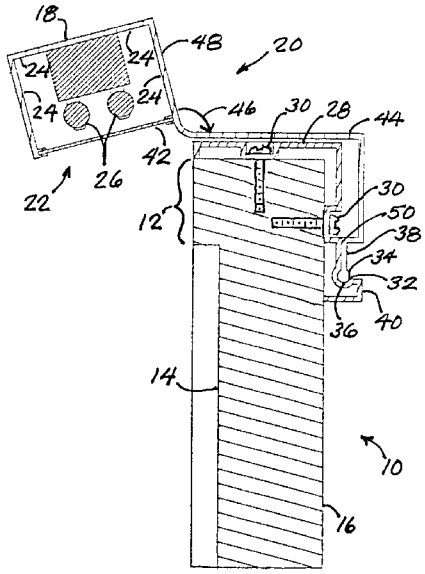
FIG. 2 illustrates a cross-section view of an upper portion of a display panel and an embodiment of the panel illumination apparatus shown in a closed (first) position for use.

Continuing with FIG. 1, another feature built into the elongated housing 18 and elongated frame 28 of the panel illumination apparatus is an open limit stop 40 defining the open position of the elongated housing 18 as shown in FIG. 1 and a closed limit stop 50 defining the closed position of the elongated housing 18 as will be shown in FIG. 2 hereinbelow. These limit stop features define the range of pivoting motion that is permissible between the elongated housing 18 and the elongated frame 28 as the illuminating assembly is pivoted from a closed or first position against the closed limit stop 50 during the use of the illuminating apparatus and an open or second position against the open limit stop 40 for servicing either the illuminating apparatus or the display panel 10 itself. The range of the angular pivoting motion of the panel illumination assembly defined by the limit stop features shown in FIGS. 1 and 2 is approximately 90°. However, other angular values may be advantageous in certain applications. Less than 90°, for example, may be useful in installation where space behind the panel is limited. In other cases, an angular range of pivoting motion greater than 90° may facilitate certain service operations.

Continuing with FIG. 1, a translucent lens 42 is positioned over the open side 22 of the elongated housing 18 to provide for dispersing or diffusing the light from light source 26 or to provide filters for changing the color of the light that illuminates the front surface 14 of the display panel 10. The translucent lens 42 may be readily secured by respective slots formed by the extrusion process into the edges of the elongated housing 18. The first light source 26 is shown generally as a standard dual element fluorescent lighting fixture. However, it will be appreciated that various kinds of standard manufacture, gas discharge or ionization lamps, whether they be single or dual bulb types, may be used in the panel illuminating apparatus of the present disclosure. The light sources may include, for example, a plurality of incandescent light fixtures mounted in a row along the length of the elongated housing 18. Other standard lighting fixtures or electronic light sources such as LEDs (light emitting diodes) may also be usable to provide the necessary illumination.

Referring now to FIG. 2, there is illustrated a cross-section view of the display panel and panel illumination apparatus similar to the cross-section view of FIG. 1, which shows an upper portion of the display panel 10 wherein the panel illumination apparatus appears in a closed (first) position for use. All features and reference numbers shown in FIG. 2 are the same as the reference numbers shown in FIG. 1 and identify the same structures. In FIG. 2, the elongated housing 18 has been pivoted in a forward direction about an axis that passes through the pivot axis of the ball and socket hinge joint 32 so that the rearward extension 44 of the elongated housing 18 rests against the elongated frame 28 which is secured to the display panel frame 12 with the fasteners 30. When in this position, the elongated housing 18 disposes the first light source 26 such that the light is radiated downward (in the particular view shown in FIG. 2) and toward the front surface 14 of the display panel 10 thus illuminating the front surface 14 of the display panel 10. This is the normal or use position of the panel illumination apparatus which may be secured in this position by techniques well known to persons skilled in the art. In some applications in which the illuminating apparatus is disposed along the sides or the bottom periphery of the display panel the light will not be radiated downward, of course, but will be radiated toward the display panel when the illuminating apparatus is in the closed or use position. The securing means is not shown in FIG. 2 for clarity purposes. The translucent lens 42, shown installed in the open side 22 of the elongated housing 18 in slots provided for the purpose to enable ease of removing or changing the translucent lens 42, provides for different colors or different dispersive effects of the light radiated from the first light source 26. The ball and socket hinge 32 is configured to provide for the snap fit assembly of the elongated closure 18 and the elongated frame 28 as well as a hinge that enables them to pivot relative to one another as described hereinabove. The snap fit feature also allows for ease of disassembly of the panel illumination apparatus contained in the elongated housing 18 from the elongated frame 28 and the rest of the display panel structure for service or change of the configuration of the panel illumination apparatus and display panel.

Figure 3:
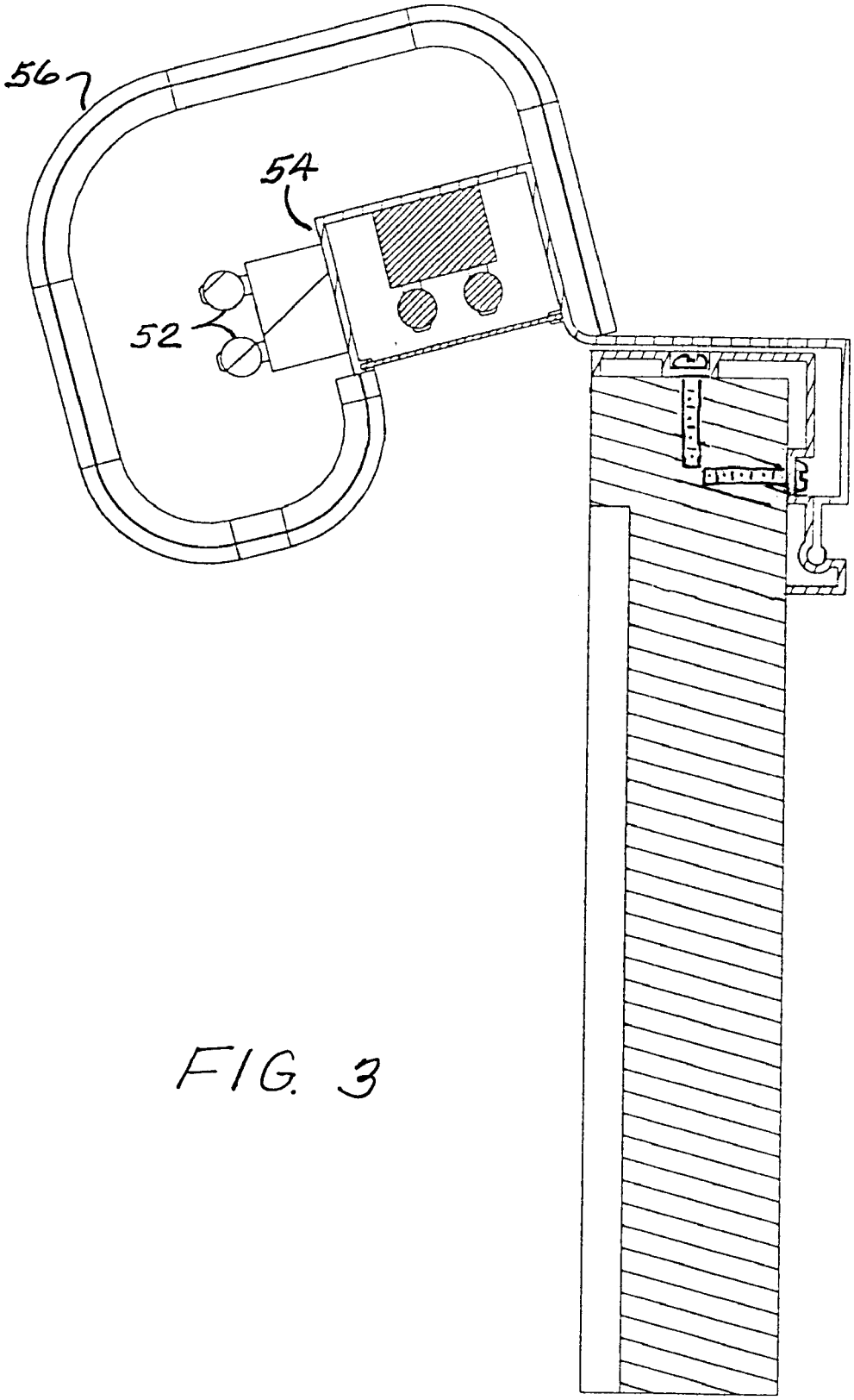
FIG. 3 illustrates an alternate embodiment of the panel illumination apparatus of FIGS. 1 and 2, having a second light source.

Referring now to FIG. 3, there is illustrated an alternate embodiment of the panel illumination apparatus of FIGS. 1 and 2 having a second light source 52 installed on an outer forward surface 54 of the elongated housing 18. In addition, there is a second translucent lens 56 which is configured as a translucent cover which encloses all of the panel illumination apparatus except for the portion through which light from the first light source is emitted toward the front display surface 14 of the display panel 10. Otherwise the structure shown in FIG. 3 is identical with that shown in FIG. 2 and the same reference numbers identify the same features in both FIG. 3 and FIG. 2. The second light source 52 and the first light source 26 may be operated together or independently to obtain the desired effects. The principle function of the second light source 52 and the translucent cover 56 is to provide an illuminated border for the display panel. It will readily be appreciated that various colors and brightnessess or sequences of illumination may be provided by the second light source 52 to enhance the overall presentation of the display panel in coordination with the illumination of the front surface 14 of the display panel 10 provided by the first light source 26.

Figure 4:
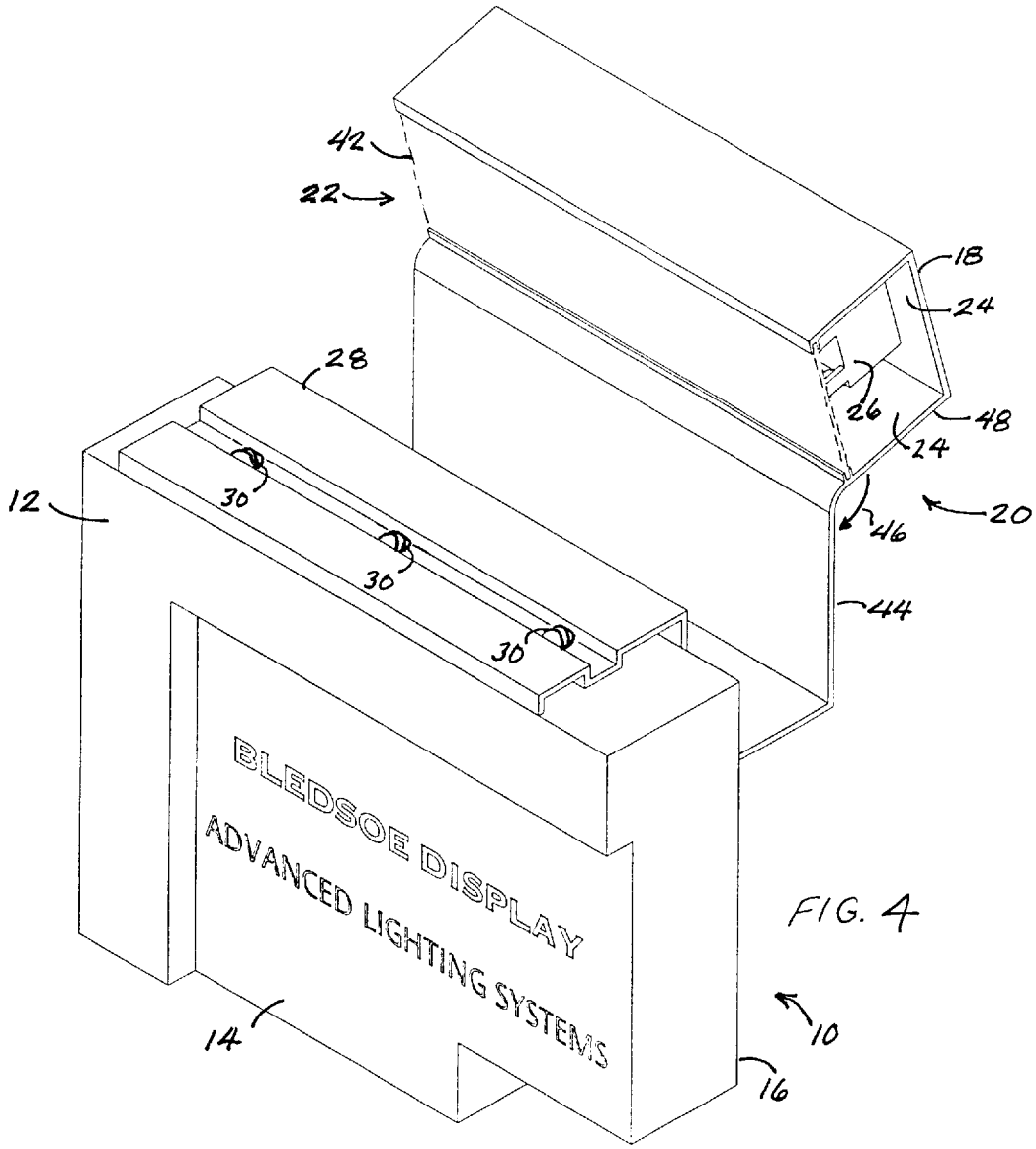
FIG. 4 illustrates a perspective view of an upper left corner of the embodiment shown in FIG. 1.

Referring now to FIG. 4, there is illustrated a perspective view of an upper left corner of the embodiment shown in FIG. 1. In FIG. 4, the display panel 10 and the panel illumination apparatus 20 are the same as shown in FIG. 1 except that the assembly is shown in a prospective view in which the panel illumination apparatus 20 is shown in an open (second) position for servicing.

Figure 5:
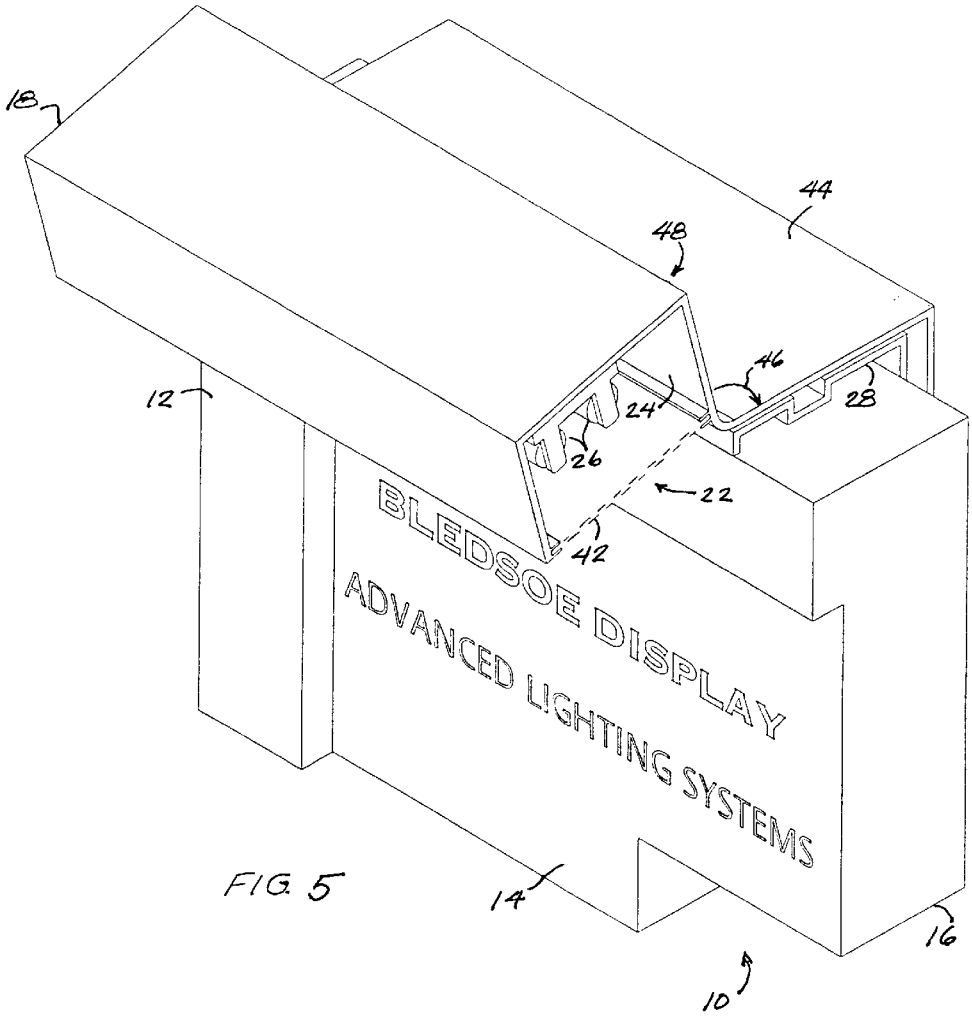
FIG. 5 illustrates a perspective view of an upper left corner of the embodiment shown in FIG. 2.

Referring now to FIG. 5, there is illustrated a perspective view of an upper left corner of the embodiment shown in FIG. 2 wherein the panel illumination apparatus 20 is shown in a closed (first) position. Again, the panel illumination apparatus 20 is in a position wherein the first light source 26 is positioned to direct the light in a downward direction toward the front surface 14 of the display panel 10.

Figure 6:
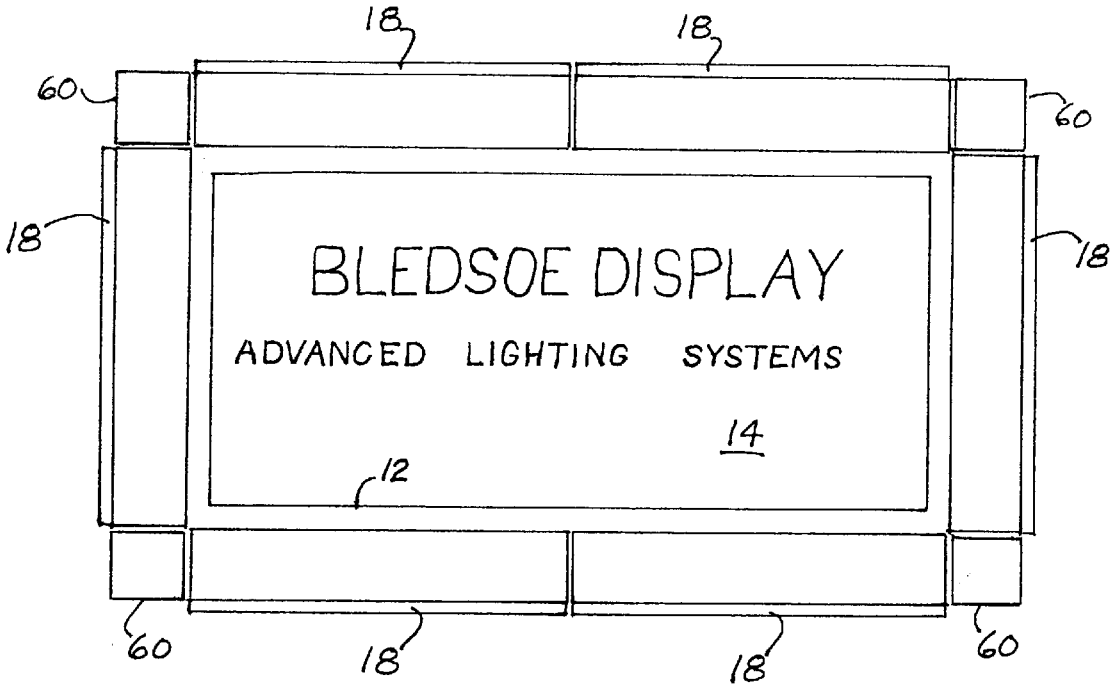
FIG. 6 illustrates a view of the front surface of a display panel equipped with panel illumination apparatus according to the present disclosure.

Referring now to FIG. 6, there is illustrated a view of the front surface of a display panel 14 equipped with a panel illumination apparatus according to the present disclosure. Each of the elongated illuminating assemblies 18 is shown in the closed or first position against the closed limit stop 50 (not shown) as it would be during use and as shown in the cross-section view of FIG. 2 or the perspective view of FIG. 5. The elongated illuminating assemblies 18 are positioned in an end-to-end relationship with each other around the periphery 12 of the display panel 14. In this illustrative embodiment a trim piece 60 is placed at each corner to fill in the notched space in the corners between the ends of the elongated illuminating assemblies 18. The trim pieces 60 may also conceal wiring connections made to the elongated illuminating assemblies 18. In some applications the elongated illuminating assemblies 18 may be wired in serial, end-to-end fashion. In other applications each elongated illuminating assembly may be wired independently.

In the illustrations of FIGS. 1–6 electrical connections, wiring and switches and the like are omitted for the sake of clarity. These components are intended to be of standard form and configuration well known in the electrical and billboard or display sign arts. In the hereinabove described embodiments the electrical operation is controlled by a control unit (not shown) which may include a regulation or control device coupled to a power source for controlling the lighting according to parameters such as ON/OFF, brightness, color, sequence and the like. The control device, for example, may include timing devices, programmable controllers, remote control capability or a communications interface such as a modem to enable remote control via a communications link.

Although the preferred embodiment has been described in detail, it should be understood that various changes, substitutions and alterations can be made therein without departing from the spirit and scope of the invention as defined by the appended claims.

What is claimed is:

1. Apparatus for illuminating a display panel having a perimeter, a front display surface and a rear surface, comprising:

an elongated housing for an illuminating assembly having a longitudinal axis and a generally U-shaped cross-section and having an open side and a light reflecting interior surface said housing disposed around and forward of said perimeter of said display panel such that said open side of said elongated housing substantially faces said front display surface of said display panel;

a first light source distributed substantially uniformly within each said housing and substantially along said longitudinal axis of said housing wherein light emitted from said first light source is substantially reflected from said light reflecting interior surface and radiated through said open side of said housing toward said front display surface of said display panel; and a frame having an outer surface, said frame attached to said perimeter of said display panel for supporting and securing said housing along said perimeter of said display panel in a pivotable relationship with said frame along and about a pivoting axis of a hinge means disposed along a rearward edge of said frame, said pivoting axis of said hinge means oriented in parallel with said longitudinal axis of said housing, wherein said housing and said frame are coupled together by said hinge means and said housing may be pivoted away from said front display surface of said display panel.

2. The apparatus of claim 1, wherein:

said elongated housing is configured in a plurality of elongated sections disposed in end-to-end relationship around and forward of said perimeter of said display panel.

3. The apparatus of claim 1, comprising:

a first translucent lens selectively disposed across said open side of said housing for filtering and dispersing said light emitted from said first light source.

4. The apparatus of claim 1, comprising:

a second light source distributed substantially uniformly along an exterior, forward facing portion of said housing and parallel to said longitudinal axis of said housing wherein light emitted from said second light source is radiated substantially forward of and away from said front display surface of said display panel to provide an illuminated border substantially around said perimeter of said display panel.

5. The apparatus of claim 4, comprising:

a light reflector disposed between said second light source and said exterior, forward facing portion of said housing for reflecting light from said second light source substantially forward of and away from said front display surface of said display panel.

6. The apparatus of claim 4, comprising:

a second translucent lens selectively disposed over said second light source for filtering and dispersing said light emitted from said second light source wherein said second light source is enclosed within said second translucent lens.

7. The apparatus of claim 4, comprising:

a second-control device for controlling said light emitted by said second light source, operable according to parameters including on/off, brightness and color.

8. The apparatus of claim 1, wherein said elongated housing for an illuminating assembly comprises:

an extrusion of rigid material configured to provide a first portion of said hinge means in cooperative relationship with a second portion of said hinge means configured with said frame.

9. The apparatus of claim 1, wherein said elongated housing for an illuminating assembly comprises:

a rearward extension of said housing, extending at an obtuse angle from a rearward external side of said housing and configured to be coupled via said hinge means to said outer surface of said frame to provide illumination toward said front display surface of said display panel when said housing is in a first position and configured to be pivoted substantially away from said first position to dispose said housing in a second position in relationship to said display panel.

10. The apparatus of claim 1, comprising:

an electrical power source electrically coupled to said first light source; and a first control device coupled to said power source for controlling said light emitted by said first light source, operable according to parameters including on/off, brightness and color.

11. The apparatus of claim 10, wherein said first control device coupled to said power source includes a regulation device.

12. The apparatus of claim 11, wherein said regulation device comprises:

a timing device for turning said light source on and off at predetermined times.

13. The apparatus of claim 11, wherein said regulation device comprises:

a programmable controller responsive to a control program.

14. The apparatus of claim 9, comprising:

a controller including a communications device for operating said first control device via a communications link from a remote controller operable by remote control for controlling said light emitted by said first light source according to parameters including on/off, brightness and color.

15. The apparatus of claim 1, wherein said first light source comprises:

one or more discharge lamps.

16. The apparatus of claim 15, wherein said first light source comprises:

a fluorescent lamp.

17. The apparatus of claim 1, wherein said first light source comprises:

a plurality of incandescent lamps arranged in a row.

18. The apparatus of claim 1, wherein said frame comprises:

an elongated frame section formed of rigid material configured for attachment to said display panel along said perimeter thereof and having disposed along its length at a rearward edge said hinge means for coupling to said housing along its length at a rearward edge to provide said pivotable relationship between said housing and said elongated frame section.

19. The apparatus of claim 18, wherein said frame comprises:

a plurality of elongated frame sections disposed in end-to-end relationship along said perimeter of said display panel.

20. The apparatus of claim 18 wherein said hinge means comprises:

a ball-and-socket relationship of said frame and said housing wherein said frame section includes a socket cross-section portion along a rearward edge thereof and said housing includes a ball cross-section portion along a corresponding rearward edge thereof;

wherein said ball cross-section portion of said housing may be assembled to said corresponding socket cross-section portion of said frame section in a snap-fit manner for retaining said ball portion within said socket portion while permitting pivotable movement of said housing relative to said frame section.

21. The apparatus of claim 18, wherein said hinge means comprises:

a ball-and-socket relationship of said frame section and said housing wherein said frame section includes a ball cross-section portion along a rearward edge thereof and said housing includes a socket cross-section portion along a corresponding rearward edge thereof;

wherein said socket cross-section portion of said housing may be assembled to said corresponding ball cross-section portion of said frame section in a snap-fit manner for retaining said ball portion within said socket portion while permitting pivotable movement of said housing relative to said frame section.

22. The apparatus of claim 18, wherein said elongated frame section comprises:

an extrusion of rigid material configured for attachment to said display panel along said perimeter thereof and configured to provide a portion of said hinge means in cooperative relationship with said housing section; and limit means for limiting the range of position of said pivotable relationship to first position and a second position and therebetween.

23. Apparatus for illuminating a display panel having a perimeter frame, a front display surface and a rear surface, comprising:

an elongated housing for an illuminating assembly having a longitudinal axis and a generally U-shaped cross-section and having an open side and a light reflecting interior surface said housing disposed proximately along and forward of said perimeter of said display panel such that said open side of said housing substantially faces said front display surface of said display panel;

a rearward extension of each said housing section contiguous with and extending from a rearward side thereof and configured for attachment to said display panel along a pivoting axis along and behind said perimeter thereof wherein said housing is positionable in a first position to provide illumination from said open side of said U-shaped housing toward said front display surface and pivotable through an angle to a second position; and a first light source distributed substantially uniformly within said housing and substantially along said longitudinal axis of said housing wherein light emitted from said first light source is substantially reflected from said light reflecting interior surface and radiated through said open side of said housing toward said front display surface of said display panel.

24. The apparatus of claim 23, comprising:

hinge means for attaching said rearward extension of each said housing to said perimeter frame of said display panel along said pivoting axis wherein said housing may be pivoted between said first position and said second position wherein said angle is defined by limit means associated with said panel.

25. The apparatus of claim 23, comprising:

a first control device controlling said light emitted by said first light source, operable according to parameters including on/off, brightness and color.

26. The apparatus of claim 23, wherein said elongated housing comprises:

a plurality of elongated sections disposed in end-to-end relationship around and forward of said perimeter of said display panel.

27. The apparatus of claim 23, comprising:

a first translucent lens selectively disposed across said open side of said housing of said elongated housing assembly for filtering and dispersing said light emitted from said first light source.

28. The apparatus of claim 23, comprising:

a second light source distributed substantially uniformly along an exterior, forward facing portion of each said housing and parallel to said longitudinal axis of said housing wherein said light emitted from said second light source is radiated substantially forward of and away from said front display surface of said display panel to provide an illuminated border substantially around said perimeter frame of said display panel.

29. The apparatus of claim 28, comprising:

a light reflector disposed between said second light source and said exterior, forward facing portion of said housing for reflecting light from said second light source substantially forward of and away from said front display surface of said display panel.

30. The apparatus of claim 28, comprising:

a second translucent lens selectively disposed over said second light source and selectively along the length of said second light source for filtering and dispersing said light emitted from said second light source wherein said second light source is enclosed within said second translucent lens.

31. The apparatus of claim 23, wherein said elongated housing for an illuminating assembly comprises:

an extrusion of rigid material providing said elongated housing and said rearward extension thereof, configured for said pivotable attachment to said display panel along said perimeter frame thereof and configured to provide hinge means in cooperative relationship with said display panel.

32. The apparatus of claim 31 wherein said hinge means comprises:

a ball-and-socket relationship of said perimeter frame and said housing wherein said perimeter frame includes a socket cross-section portion along a rearward edge thereof and said housing includes a ball cross-section portion along a corresponding rearward edge thereof;

wherein said ball cross-section portion of said housing may be assembled to said corresponding socket cross-section portion of said perimeter frame in a snap-fit manner for retaining said ball portion within said socket portion while permitting pivotable movement of said housing relative to said perimeter frame.

33. The apparatus of claim 31, wherein said hinge means comprises:

a ball-and-socket relationship of said perimeter frame and said housing wherein said perimeter frame includes a ball cross-section portion along a rearward edge thereof and said housing includes a socket cross-section portion along a corresponding rearward edge thereof;

wherein said socket cross-section portion of said housing may be assembled to said corresponding ball cross-section portion of said perimeter frame in a snap-fit manner for retaining said ball portion within said socket portion while permitting pivotable movement of said housing relative to said perimeter frame.

34. The apparatus of claim 23, wherein said rearward extension comprises:

a member joined at a first edge to said rearward side of said U-shaped elongated housing at an obtuse angle along a line parallel to said longitudinal axis of said U-shaped elongated housing and configured, at a second edge of said member opposite said first edge and parallel thereto, to include a pivot axis of a hinge means therealong about which said U-shaped elongated housing is pivotable.

35. The apparatus of claim 34, wherein said hinge means comprises:

a fixed side supported along said perimeter frame of said display panel wherein a pivot axis of said hinge means along said perimeter frame is disposed along and parallel to a rearward edge of said perimeter frame of said display panel; and a pivotable side attached to said rearward extension for supporting said elongated housing including said rearward extension in pivotable relationship with said display panel.

36. The apparatus of claim 35, comprising:

an elongated frame member disposed along and secured to said perimeter frame of said display panel upon which said fixed side of each said hinge means is secured.

37. The apparatus of claim 23, wherein said first light source comprises:

one or more discharge lamps.

38. The apparatus of claim 37, wherein said first light source comprises:

a flourescent lamp.

39. The apparatus of claim 23, wherein said first light source comprises:

a plurality of incandescent lamps arranged in a row.

* * * * *